US008235691B2

(12) United States Patent
Seabolt

(10) Patent No.: US 8,235,691 B2
(45) Date of Patent: Aug. 7, 2012

(54) DUAL DISPLACEMENT EXTERNAL GEAR PUMP

(75) Inventor: Laney A. Seabolt, Commerce, GA (US)

(73) Assignee: Roper Pump Company, Commerce, GA (US)

( * ) Notice: Subject to any disclaimer, the term of this patent is extended or adjusted under 35 U.S.C. 154(b) by 518 days.

(21) Appl. No.: 12/470,070

(22) Filed: May 21, 2009

(65) Prior Publication Data

US 2009/0297384 A1 Dec. 3, 2009

Related U.S. Application Data

(60) Provisional application No. 61/056,660, filed on May 28, 2008.

(51) Int. Cl.
*F03C 2/00* (2006.01)
*F03C 4/00* (2006.01)
*F04C 18/00* (2006.01)

(52) U.S. Cl. ..... 418/206.5; 418/132; 418/206.1; 74/462

(58) Field of Classification Search ..... 418/131–132, 418/191, 206.1–206.5; 74/462, 468
See application file for complete search history.

(56) References Cited

U.S. PATENT DOCUMENTS

| | | | | |
|---|---|---|---|---|
| 3,128,710 | A * | 4/1964 | Blomgren et al. | 418/131 |
| 3,416,459 | A * | 12/1968 | Reimer et al. | 418/132 |
| 5,161,961 | A | 11/1992 | Zheng | |
| 6,241,016 | B1 * | 6/2001 | Dedels | 418/206.1 |
| 6,672,853 | B2 * | 1/2004 | Ewald | 418/132 |

FOREIGN PATENT DOCUMENTS

| | | | |
|---|---|---|---|
| DE | 3615830 | A1 * | 11/1986 |
| EP | 445584 | | 9/1991 |
| EP | 685650 | | 12/1995 |

* cited by examiner

*Primary Examiner* — Theresa Trieu
(74) *Attorney, Agent, or Firm* — Caesar, Rivisie, Bernstein, Cohen & Pokotilow, Ltd.

(57) ABSTRACT

An external gear pump which has a certain flow rate or volumetric capacity at a given speed can be taken apart and the parts rearranged and assembled into a second pump operating at the same speed with a flow rate or volumetric capacity that is different from the original pump. No new parts are required for the second pump configuration and all original parts are used. With this structure, pumps with different flow rates can be built using fewer parts than conventional designs.

15 Claims, 2 Drawing Sheets

DUAL DISPLACEMENT EXTERNAL GEAR PUMP

CROSS-REFERENCE TO RELATED APPLICATIONS

This application claims the benefit under 35 U.S.C. §119 (e) of U.S. Provisional Patent Application No. 61/056,660, filed on May 28, 2008 entitled DUAL DISPLACEMENT EXTERNAL GEAR PUMP whose entire disclosure is incorporated by reference herein.

BACKGROUND OF THE INVENTION

1. Field of Invention

This invention is related generally to devices for pumping liquids, and more particularly, to external gear pumps used to pump liquids.

2. Description of Related Art

Typically, external gear pumps have two or more gears that may or may not have the same number of teeth. Most commonly the gears have the same number of teeth, although the gears are not limited thereto. Whether or not the gears have the same number of teeth, it is the speed of the drive gear that determines the liquid flow rate or volumetric capacity from a given pump. Therefore, the traditional method used to change the flow produced from a given pump was to change the drive gear speed.

European Publication EP/685650 A1 discloses a gear pump which fits into a cavity at a plurality of selected positions for defining distinct chambers with different axial extensions adapted to accommodate pairs of gearwheels with different axial dimensions. This provides the apparatus with a plurality of pump or motor configurations suitable for achieving a selected one of a plurality of different displacements and fluid inlet and outlet configurations. European Publication EP/445584 A1, and its corresponding U.S. Pat. No. 5,161,961 to Zheng, describes multiple equivalent pumps or motors can be made by using multiple external gears and internal gears, which are engaged with each other, along with multiple radial sealing elements, and axial sealing elements.

Many companies, including Roper Pump Company, have made pumps with two different size gears for years. However, it would be a benefit to be able to build two different pumps with different volumetric displacements from one set of parts. It would be another benefit to be able to change the flow rate or volumetric capacity of a pump without changing either the speed or the parts in the pump. All references cited herein are incorporated herein by reference in their entireties.

BRIEF SUMMARY OF THE INVENTION

The inventor has determined a new approach for making parts of a pump so that one set of parts can be used to make either of two pumps that have a different flow rate at the same pump speed. The preferred embodiments include a pump with two or more gears, two of which have different numbers of teeth. The original pump assembly has a specific flow rate or volumetric capacity at a given driven speed. The pump can be disassembled and its original parts rearranged using only the original parts to produce a second pump assembly with a totally different flow rate or volumetric capacity using the same driven speed as the original pump with virtually the same volumetric efficiency.

As an example of the preferred embodiments, the invention includes an external gear pump having a drive gear and an idler gear which have different outside diameters and a different number of teeth, a hole of the same size and shape through the drive and idler gears, a key, spline, pin or other readily removable drive feature that will cause the gear to rotate at the same speed as the shaft onto which the gear is fitted, a pump case with bores to accommodate the two different size gears, a pump case where either the large gear bore or the small gear bore may be used as the drive gear bore, a set of pump bearings that will function equally well as drive shaft bearings or idler shaft bearings, a pair of endplates that can be switched from a high drive shaft position to a low drive shaft position or vice versa and/or will attach to a case that can be switched from a high drive shaft position to a low drive shaft position or vice versa, a retaining ring in a groove in the shaft at both ends of each gear to fix the position of the shaft within the gear and therefore within the pump, and a single set of the gears and shafts which can be assembled into two different configurations, each of which will have a different flow displacement for one rotation of the drive shaft.

As another example of the preferred embodiments, the invention includes an external gear pump having a primary shaft, a drive gear, an idler gear and a pump housing. The primary shaft has a generally cylindrical body and includes a drive member. The drive gear is slip fitted on and rotatably linked about the primary shaft and is one of a first gear and a second gear. Of course, the idler gear is the other one of the first gear and the second gear. The second gear has a larger outer diameter and outer circumference than the first gear. The first and the second gear both have like-sized interior cylindrical walls defining channels having a circumference slightly larger than a circumference of the primary shaft. Both gears have a linking member associated with the drive member to link the drive gear with the primary shaft. The first and second gears are interchangeable as the drive gear on the primary shaft to deliver different flow displacement for one rotation of the primary shaft. The pump housing receives the primary shaft and encloses the first gear and the second gear. The pump housing includes a first endplate, a second endplate, and a gear case there between. The gear case has a first bored wall defining a first bore sized to accommodate the first gear, and a second bored wall defining a second bore larger than the first bore and sized to accommodate the second gear. The gear case is attached to the first and second endplates with the first bored wall fitting about the first gear and the second bored wall fitting about the second gear regardless of which of the first gear and the second gear is the drive gear rotatably linked about the primary shaft.

In one example discussed in greater detail below, the gear case, first gear and second gear are displaceable from a first orientation where the first gear is the drive gear and the second gear is the idler gear to a second orientation where the second gear is the drive gear and the first gear is the idler gear. In another example discussed below, the endplates and primary shaft are displaceable from a first orientation where the first gear is the drive gear and the second gear is the idler gear to a second orientation where the second gear is the drive gear and the first gear is the idler gear. These examples demonstrate the inventive approach for building two different pumps with different volumetric displacements from one set of parts within the dual displacement pump by changing the flow rate or volumetric capacity of the pump, without changing either the speed or the parts in the pump with parts external to the pump.

Further scope of applicability of the present invention will become apparent from the detailed description given hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skilled in the art from this detailed description.

BRIEF DESCRIPTION OF SEVERAL VIEWS OF THE DRAWINGS

The following detailed description of preferred embodiments of the invention will be better understood when read in conjunction with the following drawings, in which like-referenced numerals designate like elements, and wherein.

DETAILED DESCRIPTION OF PREFERRED EMBODIMENTS OF THE INVENTION

An exemplary dual displacement external gear pump includes a drive gear mounted on a drive shaft that is supported between two bearings and an idler gear mounted on an idler shaft that is supported between two bearings, with the teeth of the drive gear intermeshed with the teeth of the idler gear. The shaft bearings are housed and supported in a portion of the housing, which may be in either the case or the endplates, depending on the design of the pump. In addition, the drive shaft extension may be supported by an additional bearing to locate the position of the drive shaft and/or add support for radial and thrust loads on the drive shaft. There may also be a shaft seal such as a mechanical seal, lip seal or packed box to limit or eliminate leakage of the liquid being pumped. A seal less or magnetic drive arrangement may also be substituted for the typical shaft seals mention above.

The preferred embodiment includes the exemplary pump with the drive and idler gear or gears being designed with a different number of teeth and with the case being machined to accept gears of different diameters. In the preferred embodiment, the gears are designed to be separate from the shafts and the case is designed to be rotated top to bottom. In the preferred embodiment, either gear can be mounted on the drive shaft. Further, the case may be rotated to accept either the gear with comparatively more teeth or the gear with comparatively fewer teeth as the drive gear. In this preferred embodiment, at a given speed and with the gear with more teeth as the drive gear the pump will have a specific flow capacity due to the speed and displacement per revolution of the gear with more teeth as the drive gear. With the drive speed remaining the same and the drive gear switched from the gear with more teeth to the gear with fewer teeth and the case rotated 180° to accommodate the change in drive gear size, the pump will now have a lower flow capacity due to the lower displacement per revolution of the drive gear with fewer teeth. While not being limited to a particular theory, during the change of the gear in the drive position, no additional parts are required and no parts are discarded. In the preferred embodiment, one specific set of parts for a pump can be assembled to produce a specific flow capacity based on a given drive speed. That exact same set of parts can be taken apart and reassembled to produce a second pump with a different flow capacity when operating at the same speed as the first pump.

Figure 1:
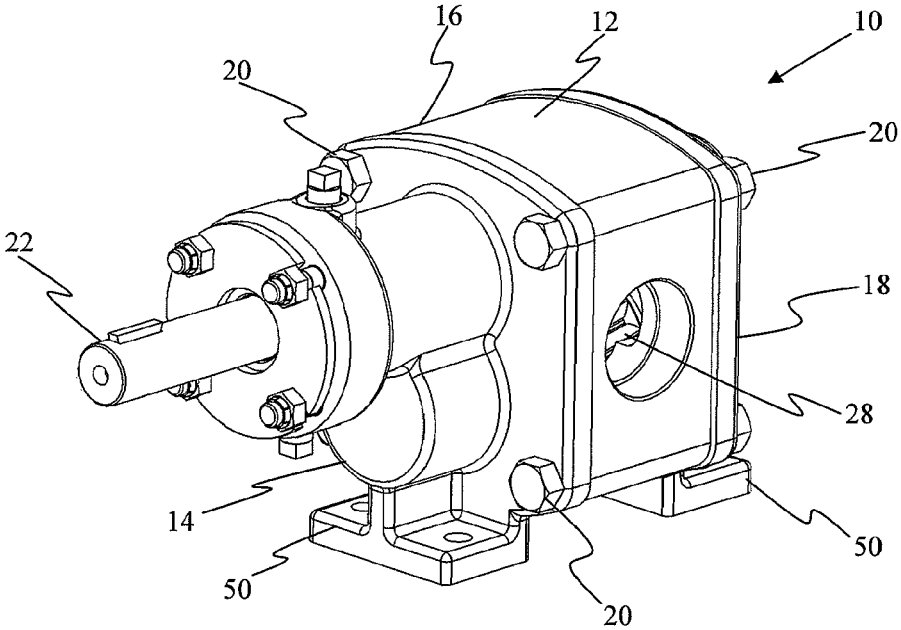
FIG. 1 is an isometric view of an exemplary embodiment of the dual displacement external gear pump device.
Figure 2:
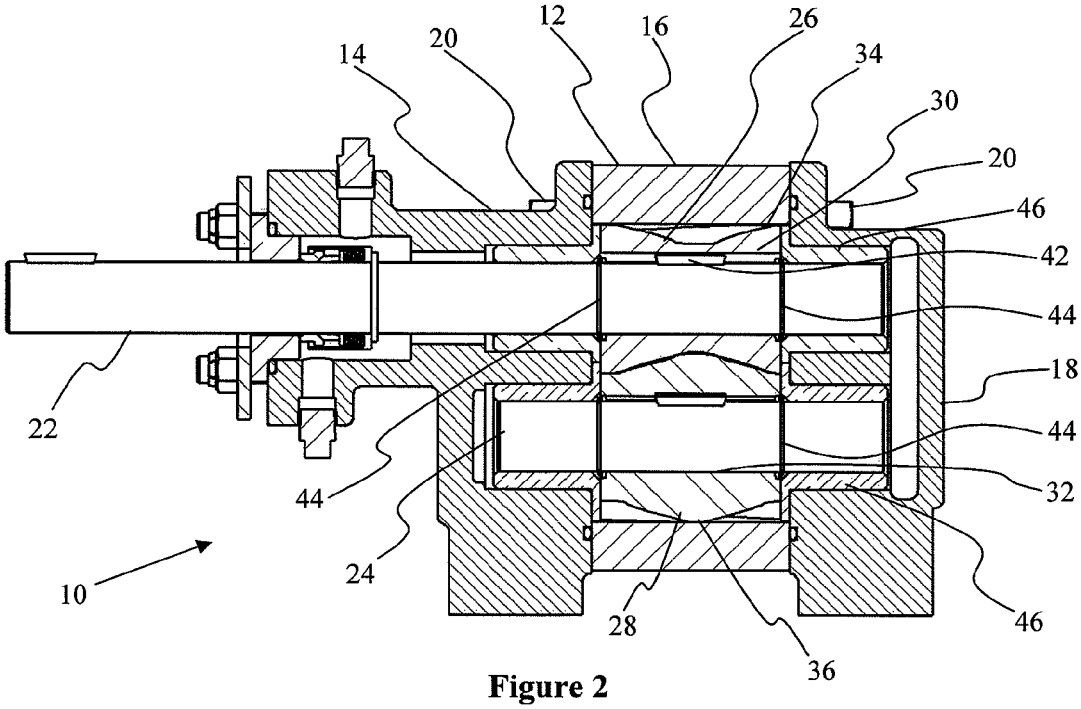
FIG. 2 is a sectional view of the exemplary dual displacement external gear pump device taken substantially along a vertical centerline of FIG. 1.

FIGS. 1 and 2 depict an exemplary dual displacement external gear pump device 10 having a housing 12 including a first end 14, a gear case 16 and a second end 18 connected via screws 20 threadedly engageable within the case to hold the housing together. A cylindrically shaped primary shaft 22 is a drive shaft that extends into and through the gear case 16. A cylindrically shaped secondary shaft 24 is an idler shaft removably enclosed within the housing 12, and has an outer circumference that is generally the same size as an outer circumference of the primary shaft 22. As can best be seen in FIG. 2, the housing 12 encloses a first gear 26 and a second gear 28, with the first gear 26 having fewer teeth than the second gear 28. The gear case 16 includes first and second bored walls 38, 40 sized for housing the first and second gears, as will be described in greater detail below. It should be noted for clarity that the first bored wall 38 is sized to fit the first gear 26, and the second bored wall 40 is sized to fit the second gear.

Still referring to FIG. 2, both gears 26, 28 have a respective interior cylindrical wall 30, 32. Both interior cylindrical walls define a longitudinal aperture sized to slip fit on and about the primary shaft 22 or the secondary shaft 24. The longitudinal apertures of the interior cylindrical walls 30, 32 preferably are the same size and shape so that either gear 26, 28 fits on either of the primary shaft 22 or secondary shaft 24. The cylindrical walls 30, 32 also include a groove as a linking member to align with and abut a matching drive member of the respective shaft 22, 24, as is described in greater detail below. In this manner, when assembled, both the shaft 22, 24 and its fitted gear 26, 28 are linked to rotate together as a rotation of one causes a rotation of the other. It is understood that the drive member and groove represent one of numerous combinations for mechanically linking the shaft and gear together, and that the invention is not limited to any specific combination thereof.

Figure 3:
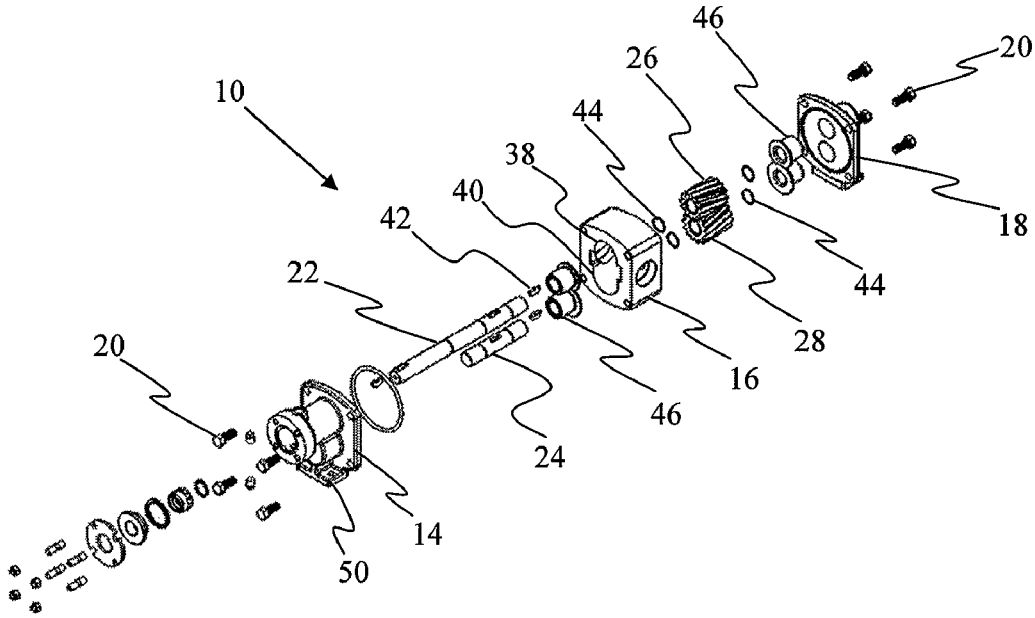
FIG. 3 is an exploded view of the exemplary dual displacement external gear pump device with the drive gear shown as the gear with the fewer number of teeth.
Figure 4:
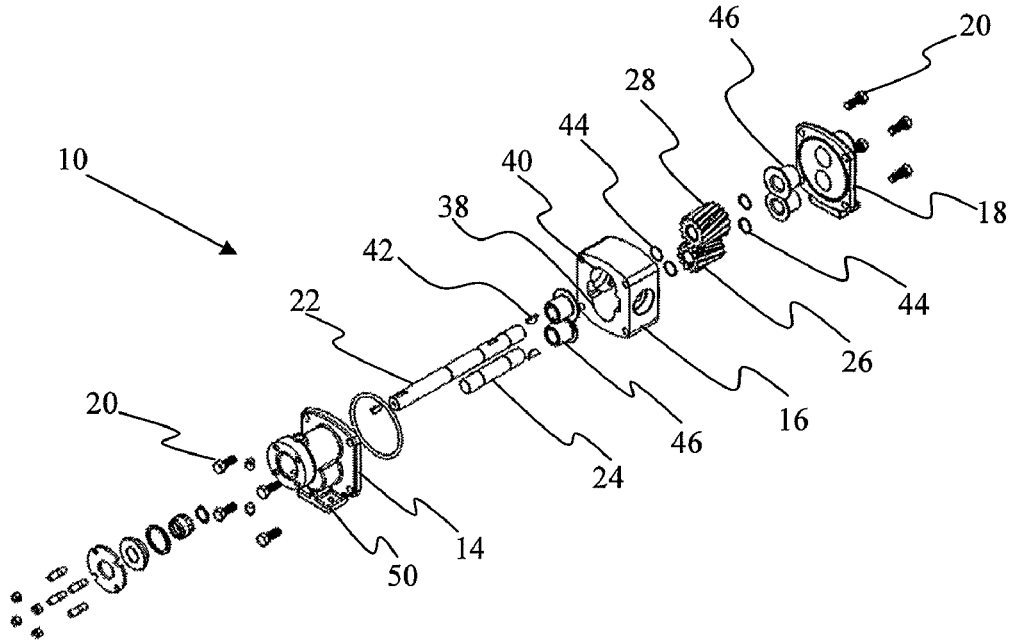
FIG. 4 is an exploded view of the exemplary dual displacement external gear pump device with the drive gear shown as the gear with the larger number of teeth.

FIG. 3 is an exploded view of the dual displacement external gear pump device 10 of FIGS. 1 and 2, showing the first gear 26 as the drive gear and the second gear 28 as the idler gear. FIG. 4 is an exploded view substantially similar to the exploded view of FIG. 3, but shows the second gear 28 as the drive gear and the first gear 26 as the idler gear. In other words, FIGS. 3 and 4 both show the external gear pump device 10; with FIG. 4 reversing the positions of the gears 26, 28. Since the first and second bored walls 38, 40 are preferably sized to closely fit a respective one of the gears 26, 28, the case 16 is shown in FIG. 4 rotated longitudinally 180 degrees so that its first bored wall 38 aligns with the first gear 26 and so that its second bored wall 40 aligns with the second gear 28.

Preferably the first gear 26 has an outer circumference and diameter less than the outer circumference and diameter of the second gear 28. For example, as can best be seen in FIG. 2, the distance between the interior cylindrical wall 30 and an outer diameter wall 34 of the smaller first gear 26 is less than the distance between the interior cylindrical wall 32 and an outer diameter wall 36 of the larger second gear 28. Both gears 26, 28 preferably have like-sized teeth defining their respective exterior shapes. Therefore, in this configuration, the smaller gear 26 has fewer teeth than the larger second gear 28, and accordingly, a lower flow rate or volumetric capacity at a given speed than the larger second gear. While not being limited to a particular theory, the gears are shown in FIGS. 2-4 as intermeshing for spatial efficiency within the case 16.

The design of the gears and case allows the gears 26, 28 and case 16 to be assembled in the two different configurations shown in FIGS. 3 and 4. At a given speed, changing from a first configuration, with the first gear 26 the drive gear and above the second gear 28, to a second configuration with the second gear the drive gear above the first gear, changes the flow rate or volumetric capacity based on which gear, the smaller gear 26 with fewer teeth or the larger gear 28 with more teeth, is fit about the primary shaft 22 and therefore used as the drive gear. FIG. 3 shows the drive gear as the first gear 26 with fewer teeth and will therefore have the lower flow rate or volumetric capacity at a given speed with this gear set. FIG. 4 shows the drive gear as the second gear 28 with the greater number of teeth and will therefore have the higher flow rate or volumetric capacity at a given speed with this gear set.

In the preferred embodiment, the drive and idler gears have a different number of teeth and a different outside diameter. The case bore walls 38, 40 for the drive and idler gears are different diameters to match up with the first and second gears 26, 28 and have the proper running clearances, as readily understood by a skilled artisan. As noted above, either the second gear 28 with more teeth or the first gear 26 with fewer teeth can be selected as the drive gear depending on the flow rate or volumetric capacity desired at the given speed. The user can change to a different flow rate or volumetric capacity at the same speed by changing the existing drive gear to the idler position in the pump and the idler gear to the drive position in the pump.

As can best be seen in FIGS. 2-4, the drive and idler gears (e.g., first and second gears 26, 28 depending on configuration) are a slip fit on the shafts 22, 24 and will cause the shafts to rotate by means of a shaft key 42, spline, pin or other removable drive member. The shafts 22, 24 have the same diameter and drive feature to allow either gear 26, 28 to mount to either shaft. The shafts are positioned and fixed within the gears by means of a retaining member, such as a retaining ring 44 seated in a groove on the shaft at both ends of each gear. The pump 10 further includes bearings 46 designed so that they have no determining features that would designate any particular bearing as a specific drive or idler shaft bearing.

The exemplary embodiments discussed herein provide an approach for building two different pumps with different volumetric displacements from one set of parts by changing the flow rate or volumetric capacity of the pump 10 without changing either the speed or the parts in the pump. For example, to change the flow rate of the pump 10 with the parts in the pump to form a different pump, a user simply needs to open up the pump and switch some of the interchangeable parts, such as the gears 26, 28. In an exemplary approach, remove the screws 20 from the gear case 16 and separate the case 16 from the ends 14, 18. Next, remove the bearings 46 and the retaining rings 44 from one side of both the drive and idler shafts 22, 24. Then switch the gears 26, 28, preferably by removing the gears 26, 28 from their linked shafts and placing the gears on the other shaft with the drive member and linking member fitted together to link the gears with their newly mated shafts. Rotate the case 16 so that the smaller bore aligns with the first gear 26, and the larger bore aligns with the second gear. Fit the case around the gears. Then reinsert the removed retaining rings 44 and bearings 46 on the shafts, and close the pump with the screws.

The gear case 16 is bored with two different size bores to accommodate the different size gears. It is understood that the end plates 14, 18 can also be modified and rotated as necessary to house the gears in either configuration (e.g., drive gear as the first gear 26, drive gear as the second gear 28), as is readily understood by a skilled artisan, without modifying the scope of the invention. For example, the endplates are preferably also shiftable from a smaller gear on top shaft holding position (FIG. 3) to a larger gear on top shaft holding position (FIG. 4), as is described in greater detail below. As can be seen in FIGS. 2-4, the second end plate 18 is shiftable 180 degrees in relation to the gear case 16 to house the shafts in either orientation. In this way, the gear case and, if needed, the endplates can be made so that the drive gear can be either the gear with more teeth or the gear with fewer teeth.

In addition to the preferred example disclosed above for changing the flow rate and volumetric capacity of a pump by interchanging the gears and rotating the gear case, the preferred embodiments include additional examples, such as shifting both endplates and shafts instead of shifting the gears/gear case. In this example, it is preferred that the endplates 14, 18 are modified to make their connecting feet 50 separate members that are connectable to opposite sides (e.g., top and bottom) of the endplates, so that shifting the endplates does not necessarily shift the connecting feet. In this manner, the connecting feet 50 remain coupled to a base member (not shown) while the endplates 14, 18 and the shafts 22, 24 are shifted to switch the drive gear and idler gear. It is understood that by shifting the shafts 22, 24, the primary shaft is moved to a different position. Thus either the gear pump 10 or a member (not shown) connected to the primary shaft 22 outside the gear pump must be moved to realign the primary shaft and the connected member. While not being limited to a particular theory, it is further understood that by shifting the orientation of the end plates and the shafts, the rotational direction of the primary shaft 22 should preferably be reversed. As noted above, switching the endplates 14, 18 and shafts 22, 24 changes the location of the shafts, which puts the drive primary shaft in the low shaft drive position. In order to keep the inlet of the pump and the discharge of the pump on their original side you would preferably reverse the rotational direction of the primary shaft 22.

It is understood that the dual displacement external gear pump described and shown are exemplary indications of preferred embodiments of the invention, and are given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof. Without further elaboration, the foregoing will so fully illustrate the invention that others may, by applying current or future knowledge; readily adapt the same for use under various conditions of service.

What is claimed is:

1. An external gear pump, comprising:

a primary shaft as a drive shaft having a generally cylindrical body and including a drive member;

a secondary shaft as an idler shaft adjacent the primary shaft;

a drive gear and an idler gear, the drive gear slip fitted on and rotatably linked about the primary shaft and being one of a first gear and a second gear, the idler gear being the other one of the first gear and the second gear and being slip fitted on the secondary shaft, the second gear having a larger outer diameter and outer circumference than the first gear, the first and the second gear both having like-sized interior cylindrical walls defining channels having a circumference slightly larger than a circumference of the primary shaft and both having a linking member associated with the drive member to link the drive gear with the primary shaft, the first and second gears being interchangeable as the drive gear on the primary shaft to deliver different flow displacement for one rotation of the primary shaft; and a pump housing receiving the primary shaft and enclosing the first gear, the second gear, and the secondary shaft within the pump housing, the pump housing including a first endplate, a second endplate, and a gear case there between, the gear case having a first bored wall defining a first bore sized to accommodate the first gear, and a second bored wall defining a second bore larger than the first bore and sized to accommodate the second gear, the gear case attached to the first and second endplates with the first bored wall fitting about the first gear and the second bored wall fitting about the second gear regardless of which of the first gear and the second gear is the drive gear rotatably linked about the primary shaft.

2. The external gear pump of claim 1, wherein the first gear has a first number of teeth and the second gear has a second number of teeth greater than the first number of teeth.

3. The external gear pump of claim 1, wherein the drive member is a shaft key attached to the primary shaft and the linking member is a groove in the interior cylindrical wall of the drive gear, the shaft key extending into the groove to link the primary shaft and the drive gear.

4. The external gear pump of claim 1, wherein the secondary shaft is rotatably linked to the idler gear within the pump housing.

5. The external gear pump of claim 4, further comprising two sets of bearings, one of the sets being drive shaft bearings located about the primary shaft on opposite sides of the drive gear, and the second of the sets being idler drive shaft bearings located about the secondary shaft on opposite sides of the idler gear, the two sets of bearings being interchangeable as the drive shaft bearings or the idler shaft bearings.

6. The external gear pump of claim 4, wherein the second endplate is rotatable to accommodate either the primary shaft or the secondary shaft.

7. The external gear pump of claim 4, wherein the primary shaft is partially enclosed within the pump housing.

8. The external gear pump of claim 1, further comprising a retaining member around the primary shaft at opposite ends of the drive gear to fix the position of the primary shaft within the drive gear.

9. The external gear pump of claim 8, wherein the retaining member is a retaining ring.

10. The external gear pump of claim 1, wherein both the drive gear and the idler gear have a plurality of teeth, the drive gear in contact with the idler gear, with the teeth of the drive gear intermeshed with the teeth of the idler gear.

11. The external pump of claim 1, the second endplate being shiftable from a smaller gear on top shaft holding position to a larger gear on top shaft holding position.

12. The external gear pump of claim 1, wherein the drive gear is the first gear and the idler gear is the second gear.

13. The external gear pump of claim 1, wherein the drive gear is the second gear and the idler gear is the first gear.

14. The external gear pump of claim 1, the gear case, first gear and second gear being displaceable from a first orientation where the first gear is the drive gear and the second gear is the idler gear to a second orientation where the second gear is the drive gear and the first gear is the idler gear.

15. The external gear pump of claim 1, the endplates and primary shaft being displaceable from a first orientation where the first gear is the drive gear and the second gear is the idler gear to a second orientation where the second gear is the drive gear and the first gear is the idler gear.

* * * * *